United States Patent [19]

Berthelsen

[11] 4,338,084

[45] Jul. 6, 1982

[54] METHOD FOR PILING OR STACKING SACKS OR BAGS

[75] Inventor: Ernst R. Berthelsen, Terndrup, Denmark

[73] Assignee: Bates Ventilsaekke Co. A/S, Nørresundby, Denmark

[21] Appl. No.: 145,855

[22] Filed: May 1, 1980

[30] Foreign Application Priority Data

Jun. 25, 1979 [DK] Denmark ..... 2651/79

[51] Int. Cl.[3] ..... B31B 1/00

[52] U.S. Cl. ..... 493/244; 493/409; 414/30; 414/54

[58] Field of Search ..... 493/244, 409–411; 229/54 R, 54 C; 270/39; 414/30, 54

[56] References Cited

U.S. PATENT DOCUMENTS 4,036,116 7/1977 Tetenborg ..... 493/244

FOREIGN PATENT DOCUMENTS 2356126 5/1975 Fed. Rep. of Germany ..... 493/244

*Primary Examiner*—William Pieprz
*Assistant Examiner*—A. Heinz
*Attorney, Agent, or Firm*—Edward F. Levy

[57] ABSTRACT

Before piling or stacking the bags, the intermediate part (1) of the bag lying between the reinforced or thickened top and/or bottom part (2,3) is folded so as to create a layer having a thickness corresponding to the thickness of the top and/or bottom parts (2,3) where these are folded flat against the bag or sack. Consequently, the bags can be stacked in great numbers without upsetting the stack or distorting the shape of it.

3 Claims, 3 Drawing Figures

METHOD FOR PILING OR STACKING SACKS OR BAGS

This present invention is concerned with the piling or stacking of sacks or bags, but mainly with the stacking of paper bags provided with thickened or reinforced top and/or bottom parts. Throughout this specification, the term 'bag' is to be understood to cover any bag, sack, or other synonym thereof.

Transportation of storage of any kind of bag normally involves the use of stacks containing a certain number of bags, kept together by a piece of string or the like. In order that these stacks or piles should come in handy sizes, it has been known to fold a number of bags, placed in a flat position one on top of the other, into a compact and handy bundle, and to tie the bundle up with string or the like.

However, that procedure has the drawback that the entire bundle must needs be taken apart to make one single bag available. It was therefore an advance to fold the bags individually and then let the folded bags go into one solid stack for easy handling, storing, and transportation. The method is applicable to several types of sack or bag, but in the case of types with reinforced or thickened tops or bottoms, e. g. bags provided with cross bottoms or block bottoms in one or both ends, a folding according to the known method would result in an irregular thickness of the folded bag. The moment the bags are stacked, the irregular thickness of each bag will result in such lopsidedness thet easy handling and storing can no longer be achieved.

A uniform and regular shape of the individual stacks and bags is of special importance where they are to be used in machines which automatically catch one at a time from a charger containing a large number of bags in a vertical position.

It is thus the purpose of this present invention to provide a method or procedure for piling or stacking bags so as to ensure an appropriate and effectual size and also a regular and uniform thickness of the individual bags and thereby the entire stack of bags.

According to this present invention, this is achieved by bending the bottom and/or the top part flatly against the bag, and by providing the bag outside or between the reinforced or thicker parts with folds so as to create a layer with an overall thickness roughly corresponding to the total thickness of the bag where the reinforced top and/or bottom part have been folded down.

By folding each individual bag in this way, an almost uniform thickness of each bag is achieved, which allows the piling of bags to make a regular and even stack which can be tied together with string or otherwised closed to contain a definite, arbitrarily chosen number of bags, and such stack thereby stands out as one solid, compact, and handy bundle, easy to transport and store.

The uniform dimensions and the level and horizontal stacking thus achieved further ensures the direct use of bundles of bags in chargers fitted to machines which automatically catch each individual bag.

The regular and uniform shape of each stack also has the advantage of increased protection to the bags against damage during transport.

Where the folding of the bags follows the method indicated in claim 2, i.e. by turning upwards the top and/or bottom parts when the bags are placed level and horizontal, the result is that bags with sized cross bottoms are easily inspected for defects in the quality of the sizing. Where bags with single sized cross bottoms are concerned, or so-called valve bags with double bottoms and a valve opening at one end, the quality of the sizing is of crucial importance, as defective sizing will render the bag useless for its purpose.

A particularly simple way of folding the bag, in accordance with claim 3, will be to provide the bag with such folds and bends so as to result in a 'Z'-shape, as seen on a cross-section taken through the longitudinal axis of the bag.

One embodiment of the present invention will now be described by way of example with reference to the accompanying drawings, showing the folding of a so-called valve bag, in which.

Figure 1:
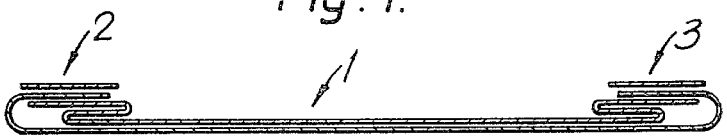
FIG. 1 is a longitudinal section through a valve bag
Figure 2:
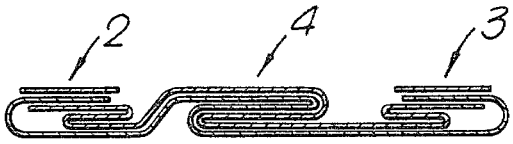
FIG. 2 is a longitudinal section through a folded valve bag
Figure 3:
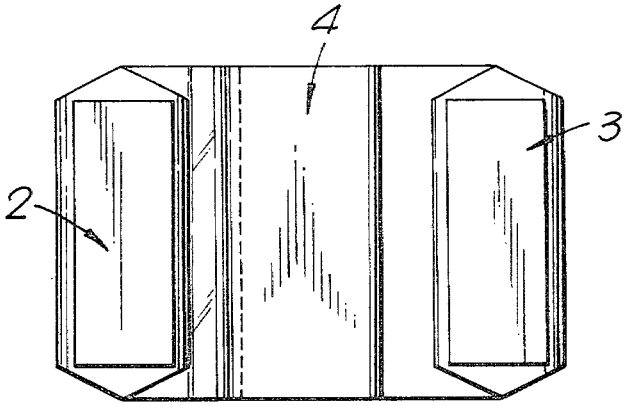
FIG. 3 is a plan of a folded valve bag.

In connection with one embodiment of the method or procedure according to the invention, here further explained using a valve bag 1, provided with two sized cross bottoms 2 and 3, one being fitted with a valve opening, the bottoms 2 and 3 are first positioned level with the bag 1 and with the sizing facing upwards. Next, the part of the bag 1 which lies between the two bottoms 2 and 3 is folded in such manner that the folds 4 present a Z-formed shape when the bag is seen on a longitudinal section. In this way it has been achieved to provide the bag with a uniform thickness when folded.

Even though the invention has here been explained in connection with a valve bag, it remains quite obvious that the principle behind the method according to the invention is applicable to any kind of bag provided with reinforcements or thicker parts of any nature whatsoever.

The shape or design of the folding may be arbitrarily chosen and shall not be limited to one single folding, but may consist of several reciprocating pleats or folds, depending on the desired overall thickness.

The positioning of the folds and the number of intervals between the thicker parts is subject to variation in the same manner, and shall still be considered within the scope and underlying principles of the present invention.

What we claim is:

1. A method of stacking elongated valve bags having closed opposite ends each formed by a thickened reinforced folded and sized portion, one of which contains a valve opening, comprising the steps of placing each bag in flat condition with the sized end portions thereof folded flatly against the body of the bag and facing upwardly, and with the folds at each end portion presenting a multi-ply formation of greater thickness than the intermediate portion of the bag between said folds, folding said intermediate portion of the bag between said folded end portions along spaced fold lines transverse to the longitudinal axis of said bag into a multi-ply formation having a thickness substantially equal to the thickness of the folded formations at the ends of the bag, and stacking said folded bags in horizontal flat condition, one upon another, with the folded and sized end portions facing in the same direction, the valve openings registering with each other, and the edges of the bags in alignment.

2. A method according to claim 1 in which the bag is positioned flat and horizontal with the folded formations at the end portions of the bag facing upwardly, as said folded bags are stacked one upon another.

3. A method according to claim 1 or claim 2 in which the intermediate portion of the bag is folded in such a manner that the folds present a Z-shaped configuration when viewed along a longitudinal section through said bag.

* * * * *